United States Patent [19]

Herring

[11] 4,047,017

[45] Sept. 6, 1977

[54] ADJUSTABLE FLASHLIGHT SWINGABLE BRACKET FOR A WRITING INSTRUMENT

[76] Inventor: Bernard D. Herring, 712 Longridge Road, Oakland, Calif. 94610

[21] Appl. No.: 668,784

[22] Filed: Mar. 22, 1976

[51] Int. Cl.[2] ..... B43K 29/10

[52] U.S. Cl. ..... 240/6.46; 240/2 E

[58] Field of Search ..... 240/6.46, 2 E

[56] References Cited

U.S. PATENT DOCUMENTS

| | | | |
|---|---|---|---|
| 1,199,392 | 9/1916 | Lenzikow et al. | 240/6.46 |
| 1,345,962 | 7/1920 | Sanders | 240/6.46 |
| 2,135,802 | 11/1938 | Dinkins | 240/6.46 |
| 2,189,715 | 2/1940 | Hoiseth | 240/6.46 |

FOREIGN PATENT DOCUMENTS

| | | | |
|---|---|---|---|
| 706,751 | 3/1965 | Canada | 240/6.46 |

*Primary Examiner*—Monroe H. Hayes
*Attorney, Agent, or Firm*—William R. Piper

[57] ABSTRACT

A flashlight mounted on a swingable bracket that can be adjustably mounted on a writing instrument such as a pencil, fountain pen or ballpoint pen. The flashlight can be positioned with respect to the writing instrument so as to direct the light rays to illuminate the surface directly contacted by the writing instrument. The area of the lighted field can be varied in size by adjusting the bracket to move the flashlight toward or away from the writing end of the instrument on which the swingable bracket is adjustably mounted. The bracket has two instrument gripping clips that engage the instrument for holding the flashlight and bracket in a substantially linear position paralleling the axis of the writing instrument when the device is in an inoperative position.

1 Claim, 3 Drawing Figures

ADJUSTABLE FLASHLIGHT SWINGABLE BRACKET FOR A WRITING INSTRUMENT

SUMMARY OF THE INVENTION

An object of my invention is to provide an inexpensive swingable bracket for supporting a flashlight, the bracket having two clips, one clip for adjustably securing the bracket to a writing instrument and the other clip for gripping the writing instrument for holding the device in an inoperative position. The swingable bracket permits the angular position of the flashlight to be adjusted with respect to the writing instrument to suit the requirement of the person using the device.

DESCRIPTION OF THE PREFERRED EMBODIMENT

In carrying out my invention I disclose a slidable base member A that has two spaced apart integral clips B, and C whose pairs of arcuate shaped spring arms yieldingly and slidably grip a writing instrument, such as a pencil D, for holding the base in adjusted position on the writing instrument. An arm E is pivotally connected to the base A, at 1 and a flashlight supporting platform F, has one end pivotally connected at 2 to the outer end of the swingable arm E. Both pivots 1 and 2 are of the semi-friction type which permits the arm E and platform F to be swung into different angular positions, but will hold the positions into which they have been swung.

Figure 3:
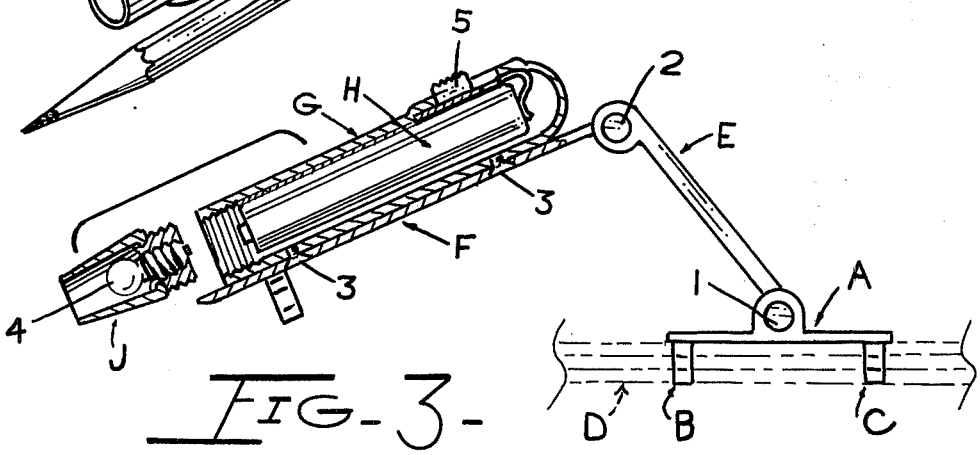
FIG. 3 is a longitudinal section through the flashlight with the bulb casing removed so as to permit access to the battery disposed within the battery casing.

The platform F supports a flashlight casing G which may be secured to the platform in any manner desired such as by rivets 3, see FIG. 3. The flashlight is of standard construction and includes a battery H that is housed within the casing G. A bulb holding casing J receives an electric bulb 4 and the casing J is removably secured to the battery casing G. Any type of battery switch for the flashlight G may be used and I have shown a standard slidable ON/OFF switch at 5. FIG. 3 shows the bulb holding casing J removed from the battery casing G for the purpose of clarity.

Figure 2:
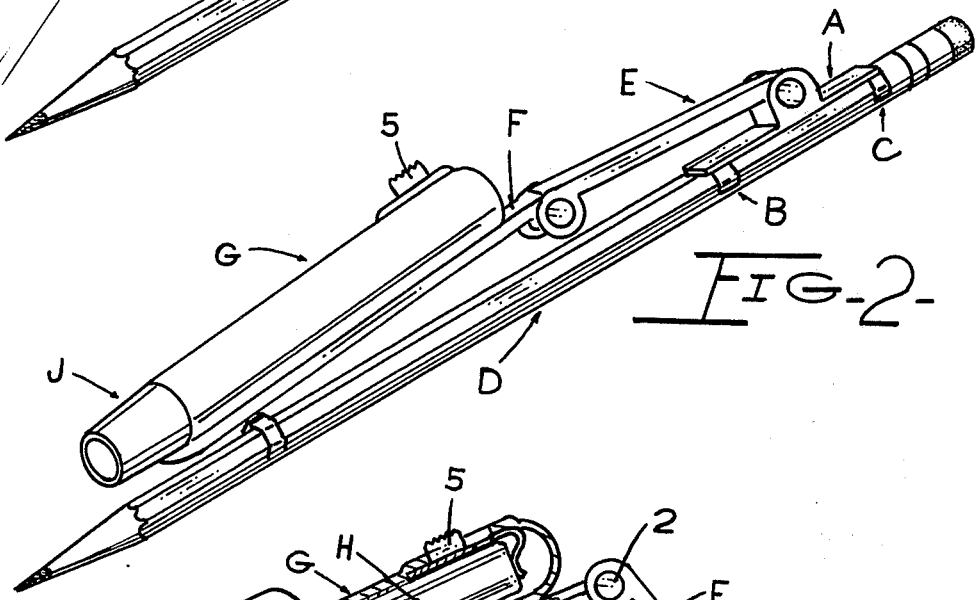
FIG. 2 is a perspective view illustrating the device in an inoperative position with respect to the writing instrument and is held in place by two spaced apart instrument gripping clips.

The flashlight supporting platform F, is provided with an integral clip K that is designed to removably engage with the writing instrument D when the device is in an inoperative position, see FIG. 2. This Figure illustrates the arm E and the platform F swung substantially into parallel relation to the length of the writing instrument D, and being positioned adjacent thereto. When the parts are in this position the writing instrument may be readily carried in the pocket of the user without creating an unduly bulky device.

OPERATION

Figure 1:
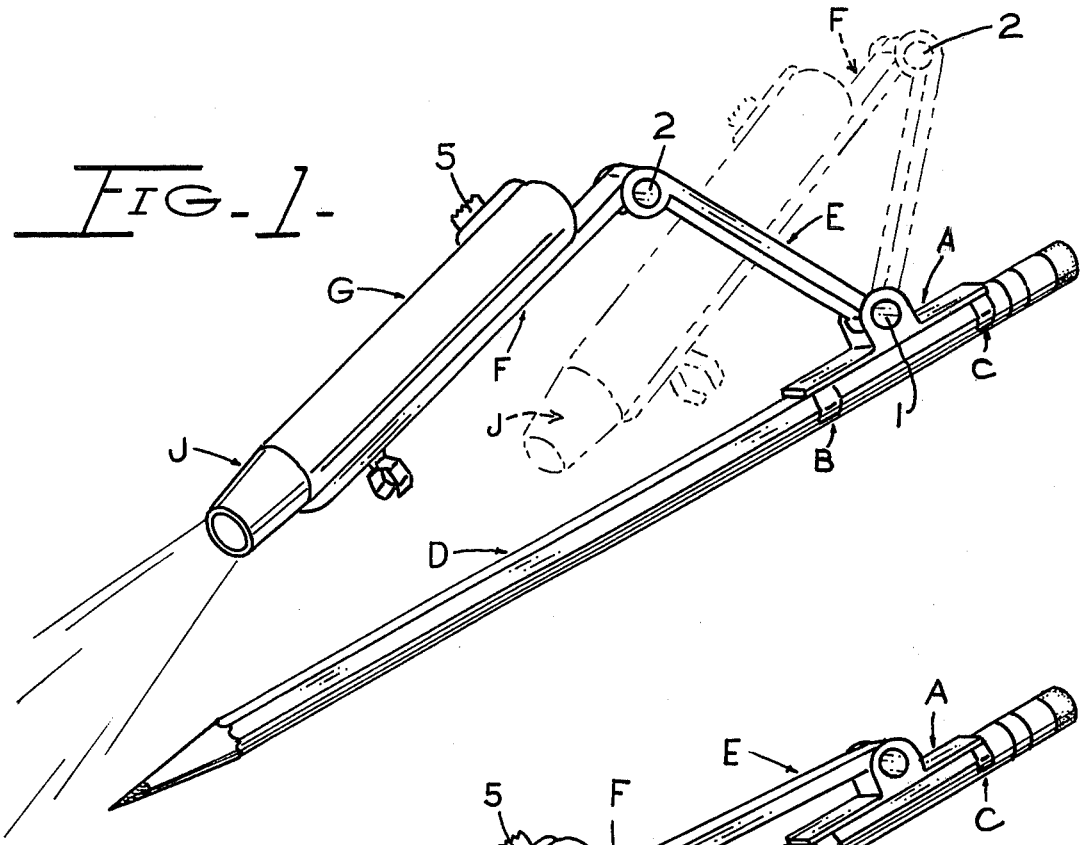
FIG. 1 is a perspective view of the device shown adjustably secured to a writing instrument and held in operative position. A double-dot-dash line indicates another position of the device.

From the foregoing description of the various parts of the device the operation thereof may be readily understood. I have already described the inoperative position of the device on the writing instrument as is shown in FIG. 2. When the operator wishes to use the device to illuminate a page on which he is to write data, he swings the flashlight supporting platform F away from the writing instrument as is shown in FIG. 1. In doing this the clip K, is pulled loose from the writing instrument and both the platform F, and the arm E, are swung about the pivots 1 and 2 until the flashlight G, is moved into the correct position for providing the proper illumination on the surface to be illuminated and there is sufficient space between the platform F and the writing instrument D for the operator to grip the writing instrument and not be interferred with by the platform F.

I have shown two positions of the flashlight G with respect to the writing instrument in FIG. 1. It is possible to slide the base member A along the writing instrument D to any desired position thereon. The device has great stability with respect to the writing instrument because the base A has two spaced apart spring clips B, and C that grip the writing instrument. Also the friction creating pivots 1 and 2 will hold the arm E and the platform F, in any position into which they have been swung. The particular type of hinge bracket provides great flexibility of adjustment for the flashlight G so as to illuminate the desired field and also control the intensity of the light directed onto the field by moving the flashlight toward or away from it.

The device is not cumbersome to adjust and is not bulky is size. No screws are needed to secure the device to the writing instrument. The weight of the various parts of the device is so distributed as to facilitate the handling of the writing instrument when used. The device is simple in construction, durable and efficient for the purpose intended and it can be manufactured at minimal expense. The flashlight is so positioned with respect to the writing instrument as to offer no obstruction to the illuminated field on which the writing takes place. The illuminated field automatically moves with the writing instrument as the latter is moved across the surface on which the writing takes place.

Any glare from the light on the illuminated field can be eliminated by adjusting the flashlight to the proper angle. The simplicity of the device gives it a distinct aesthetic design appeal. The forward clip K, on the platform F permits the platform to be removably anchored to the writing instrument when the device is in inoperative position. The platform F, and the arm E, are in a substantially linear alignment and parallel the length of the writing instrument as well as lie adjacent thereto. This permits the writing instrument to be readily carried in the pocket. The device will not mar the exterior surface of the writing instrument to which it is attached.

I claim:

1. In combination:

a. a base having a spring clip for frictionally gripping the elongated body of a writing instrument and permitting adjustment along the length of the body;

b. an arm having one end pivotally secured to said base and being swingable from a position substantially paralleling the elongated body of the writing instrument into a desired angular position with respect to the axis of the body;

c. a flashlight supporting platform having one end pivotally connected to the free end of said arm, the axis of said platform lying in a radial plane that extends from the axis of the elongated writing instrument, the elongated axis of said arm lying in the same plane regardless of its angular position; and d. said platform supporting a flashlight whose light rays are always beamed along said radial plane regardless of the angle made between said platform axis and said supporting arm axis, the angle of the light rays being adjusted by the swinging of said platform and said arm for directing the light rays toward the writing end of said instrument for illuminating a surface over which the writing instrument is moved, said pivotal connections between the base, arm and platform holding said arm and platform in adjusted position so that both will space the flashlight away from the body of the writing instrument for permitting the latter to be manually grasped without interfering with the flashlight;

e. said platform being provided with a spring clip for removably engaging the body of the writing instrument when said arm and platform are swung into substantial linear alignment with each other, said last mentioned spring clip when engaging with the body of the writing instrument holding said platform and arm close to and substantially parallel with the adjacent side of the elongated body of the writing instrument.

* * * * *